United States Patent [19]

Soper et al.

[11] Patent Number: 4,535,566

[45] Date of Patent: Aug. 20, 1985

[54] APPARATUS FOR MOVING A TOOL IN A CONTROLLED MANNER

[75] Inventors: Peter H. H. Soper, Rugby; Andrew S. Cammack, Estover, both of England

[73] Assignee: Autoflow Engineering Limited, Warwickshire, England

[21] Appl. No.: 493,331

[22] Filed: May 10, 1983

[30] Foreign Application Priority Data

May 10, 1982 [GB] United Kingdom ..... 8213396

[51] Int. Cl.[3] ..... B24B 13/00; B24B 17/02

[52] U.S. Cl. ..... 51/124 L; 51/127; 51/33 W; 51/55

[58] Field of Search ..... 51/33 W, 55, 34 A, 124 L, 51/127, 101 LG, 284 R, 101 R; 125/11 TP; 74/99 R, 102; 82/19; 409/162, 183

[56] References Cited

U.S. PATENT DOCUMENTS

| | | | |
|---|---|---|---|
| 2,424,271 | 7/1947 | Galloway | 51/33 W |
| 2,806,327 | 9/1957 | Coburn | 51/124 L X |
| 3,449,865 | 6/1969 | Suddarth | 51/55 |
| 3,685,210 | 8/1972 | Bowen | 51/33 N |
| 4,068,413 | 1/1978 | Suddarth | 51/124 L |

*Primary Examiner*—Frederick R. Schmidt
*Assistant Examiner*—Debra S. Meislin

[57] ABSTRACT

Apparatus for moving a tool such as a grinding wheel of a lens generating machine comprises a carrier for the tool which is movable about a pivot along an arcuate path and a cam and follower device operable to move the carrier along a slideway transverse to the arcuate path as a result of movement of the carrier about the pivot. In that way the tool can be controlled so that it follows a locus determined by the two movements.

11 Claims, 9 Drawing Figures

APPARATUS FOR MOVING A TOOL IN A CONTROLLED MANNER

The invention relates to apparatus for moving a tool in a controlled manner and is particularly, but not exclusively, concerned with apparatus for controlling movement of a lens grinding wheel.

Manufacturers of lenses usually have machinery which will enable them to make lenses within a particular range of curvatures corresponding to those which make up the bulk of their business. However, such manufacturers are sometimes asked by customers to produce lenses which are outside the range of their machinery. This usually means that the manufacture needs to use skilled labour to make the special lenses or needs to put the order out to a specialist lens manufacturer which is an inconvenience. The limitation on curvature is due to the fact that the grinding wheel used to generate the lens must normally be positioned relative to a pivot about which it is swung during grinding of the lens surface. Obviously, to produce low power lens having a very shallow curvature in one plane, the distance between the grinding wheel and the pivot must be considerable whilst to produce a high power lens the distance between the grinding wheel and the pivot is relatively small. The majority of lens generating machines can cope with the higher power lenses and with lenses of down to around three dioptres. However, manufacture of lenses of lower power can be a problem to mass producers and one object of the present invention is to provide a single lens generating machine which can produce a wider range of curvatures than is usually possible with a single lens generating machine of the kind known hitherto.

According to one aspect of the invention there is provided lens generating apparatus comprising a carrier for a grinding wheel which carrier is movable along a first path, and means for moving the carrier along a further path transverse to the first path as a result of movement of the carrier along the first path.

If the first of those paths is a curved path then by moving the carrier approximately transverse to the curved path the locus of the grinding wheel can be varied to provide, if necessary, a curvature in one plane having a radius of up to infinity (i.e. plano lens condition). However, the apparatus can still produce curvatures in the more normal range and so is extremely versatile.

Preferably the carrier is slidably supported on a mounting which is pivotably mounted on a bed, said means for moving the carrier comprising a first part on the bed and a second part co-operable with the first part as the mounting moves about its pivot to move the carrier along said first path, said second part being arranged to slide the carrier on said mounting along said second path. In such a case the first part of the means for moving the carrier along the second path may comprise a cam and said second part may include lever means on the mounting, said lever means including a first portion which engages the cam and a second portion which co-operates with the carrier. Where the lens to be generated does not require the carrier to be moved along the mounting the carrier can be moved clear of the second portion of the lever means.

Preferably, the second part of the carrier moving means also includes a resilient means and the carrier is slidable along the mounting to a desired position by a rotary screw which carries a screw-threaded sleeve, said sleeve being arranged to transmit drive to the carrier in one direction through an abutment fast with the carrier and in the opposite direction through said resilient means, the arrangement being such that the lever means moves the carrier along the second path against the bias of said resilient means in one direction and said resilient means effects return movement of said carrier.

It has been found desirable to vary the orientation of the grinding wheel relative to the workpiece when moving the carrier along said first and second paths so that its angular displacement corresponds substantially to that which would occur if the grinding wheel were moved along the first path about a pivot spaced therefrom by the radius of curvature generated. Preferably, therefore, the tool carrier comprises a fixed section on the mounting and a movable section pivotally mounted on the fixed section to enable the orientation of the grinding wheel to be varied relative to the workpiece, adjustment means being mounted on the bed which pivots the movable section relative to the fixed section as a result of the mounting pivoting on the bed. The adjustment means may be mounted on the bed and may comprise a linkage comprising a first arm connected to the bed by a first pivot and a second arm attachable to said movable section and connected to the first arm by a second pivot. In such a case the distance between the second pivot of the linkage and the pivot of the movable section may be adjustable by altering the position of the second pivot on the second arm, the pivot for the mounting, the pivot for said movable section and said first and second pivots of the linkage being located at the four corners of a notional quadrilateral so that the second arm follows a desired locus as the mounting is moved about its pivot to control movement of the said movable section about its pivot. The adjustment of the pivot of the movable section enables the orientation of the grinding wheel to be varied for convex (plus) and concave (minus) curvatures to be generated by the apparatus. Preferably, locking means is provided on the bed for locking the mounting means in a desired pivotal position relative to the bed prior to adjusting the position of said second pivot on the second arm of the linkage.

Where a manufacturer already possesses a lens generating machine, the means for moving the grinding wheel carrier along the further path may comprise a removable attachment for the existing machine. Likewise the aforesaid adjustment means may take the form of a further removable attachment.

It is envisaged that the apparatus may be applicable in fields other than lens manufacturing and according to another aspect of the invention there is provided apparatus for moving a tool in a controlled manner comprising a carrier for the tool which is movable along a first path and means for moving the carrier along a further path transverse to the first path as a result of moving the carrier along said first path.

Apparatus in accordance with the invention will now be described by way of example with reference to the accompanying drawings in which.

Figure 1:
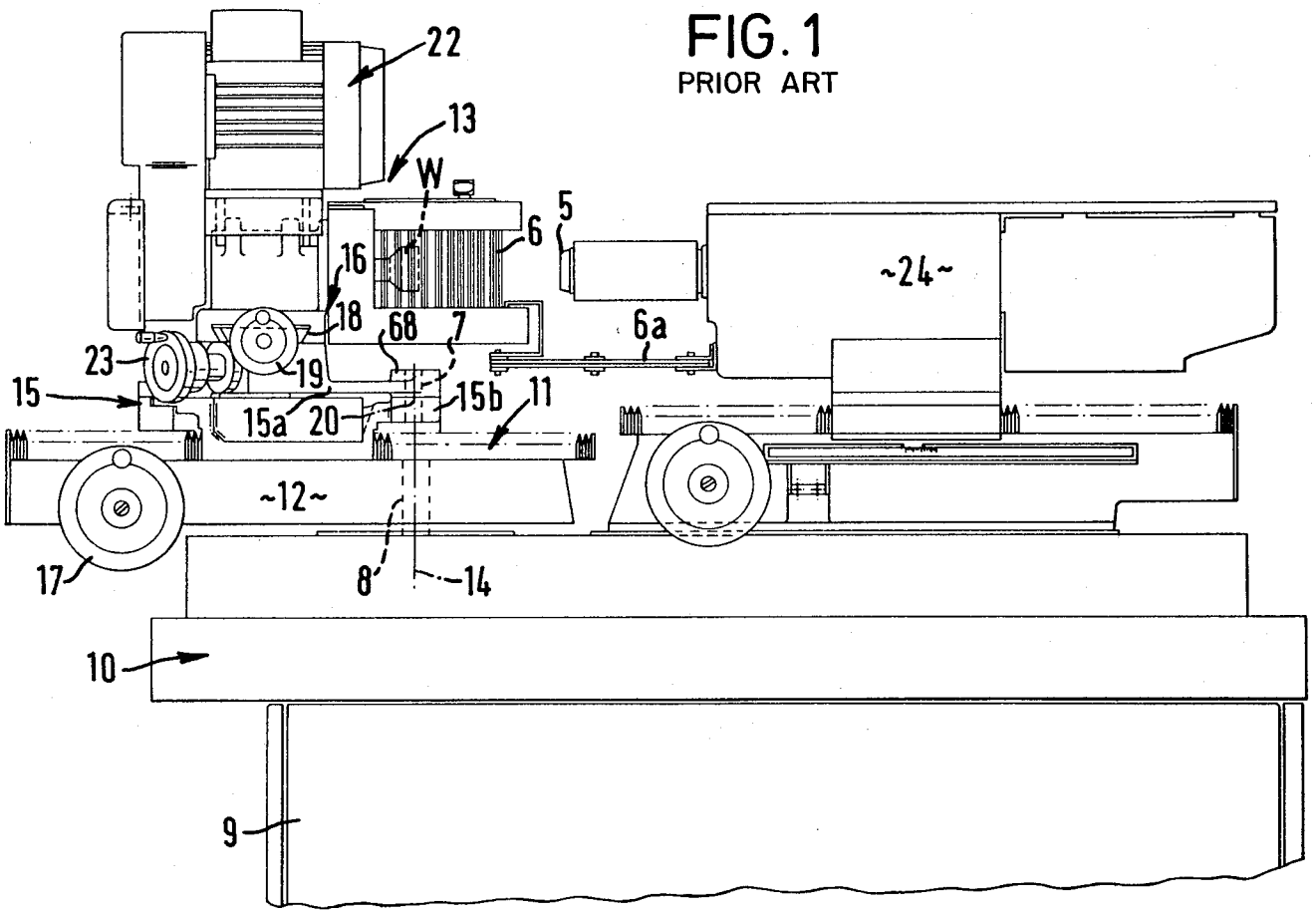
FIG. 1 PRIOR ART
FIG. 1 is an elevation of a known kind of toric lens generating machine known as the AUTOFLOW HYALINE.
Figure 2:
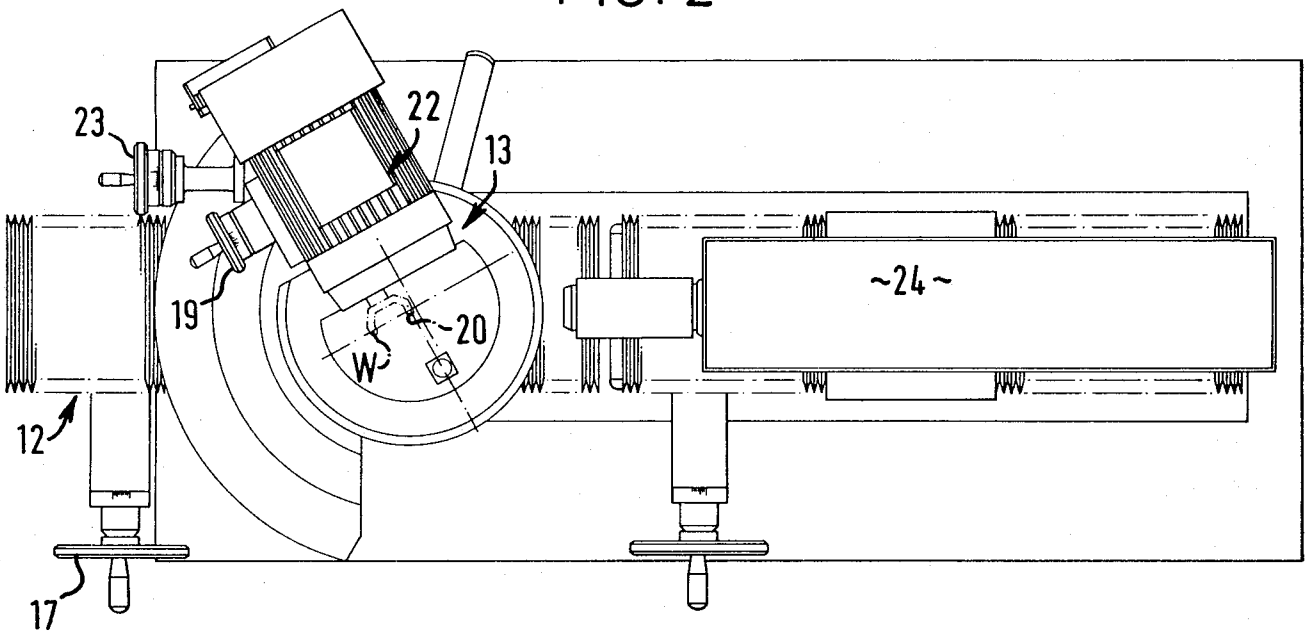
PRIOR ART FIG. 2
FIG. 2 is a plan view of the machine shown in FIG. 1.

Referring to FIGS. 1 and 2, the lens generating machine comprises a bed 10 on a stand 9. A mounting 12 for a tool carrier 13 is rotatable on the bed 10 about a pivot 8 having an axis 14. The tool carrier 13 comprises two main sections 15, 16. The first section 15 is movable longitudinally of the mounting in a slideway 11 by means of a hand wheel 17, and the second section 16 is movable in a slideway 18 on the first section 15 by means of a handwheel 19. The first section 15 has upper and lower portions **15*a*, 15*b* which are interconnected by a pivot 7 having an axis 20. The upper portion 15*a* can be pivoted on the lower portion 15*b* about the axis 20. The tool (usually a cup-shaped diamond impregnated grinding wheel W) is positioned angularly relative to the longitudinal axis of the mounting 12 in known manner by pivoting the upper portion 15*a* about axis 20. Such pivoting movement is effected by a handwheel 23. The wheel is also positioned by the handwheel 19 so that its mean circumference lies substantially at a tangent to the axis 20 in known manner as shown in FIG. 2. The grinding wheel is housed in a grinding chamber surrounded by a concertina-like curtain 6 having an opening therein (not shown) which is maintained in alignment with a workpiece 5 by a centralising device 6*a* (FIG. 1). The tool carrier is moved into an appropriate position relative to a workpiece holder 24 on the bed of the machine so that the axes 14, 20** are spaced to generate the desired curve on a lens blank in the horizontal plane. The workpiece holder will not be described in detail.

The basic Hyaline machine is capable of grinding lenses of various curvatures within a given range and is very satisfactory. However, there are occasions when a lens is required having a large radii of curvatures in two planes outside the range of the basic machine.

Where a very large radius of curvature is required it may not be possible to position the axis 20 sufficiently far from axis 14 to achieve it and one object of the present invention is to enable a machine of the types shown in FIG. 1 to generate a lens surface having a radius of curvature hitherto outside the range of the machine.

Figure 3:
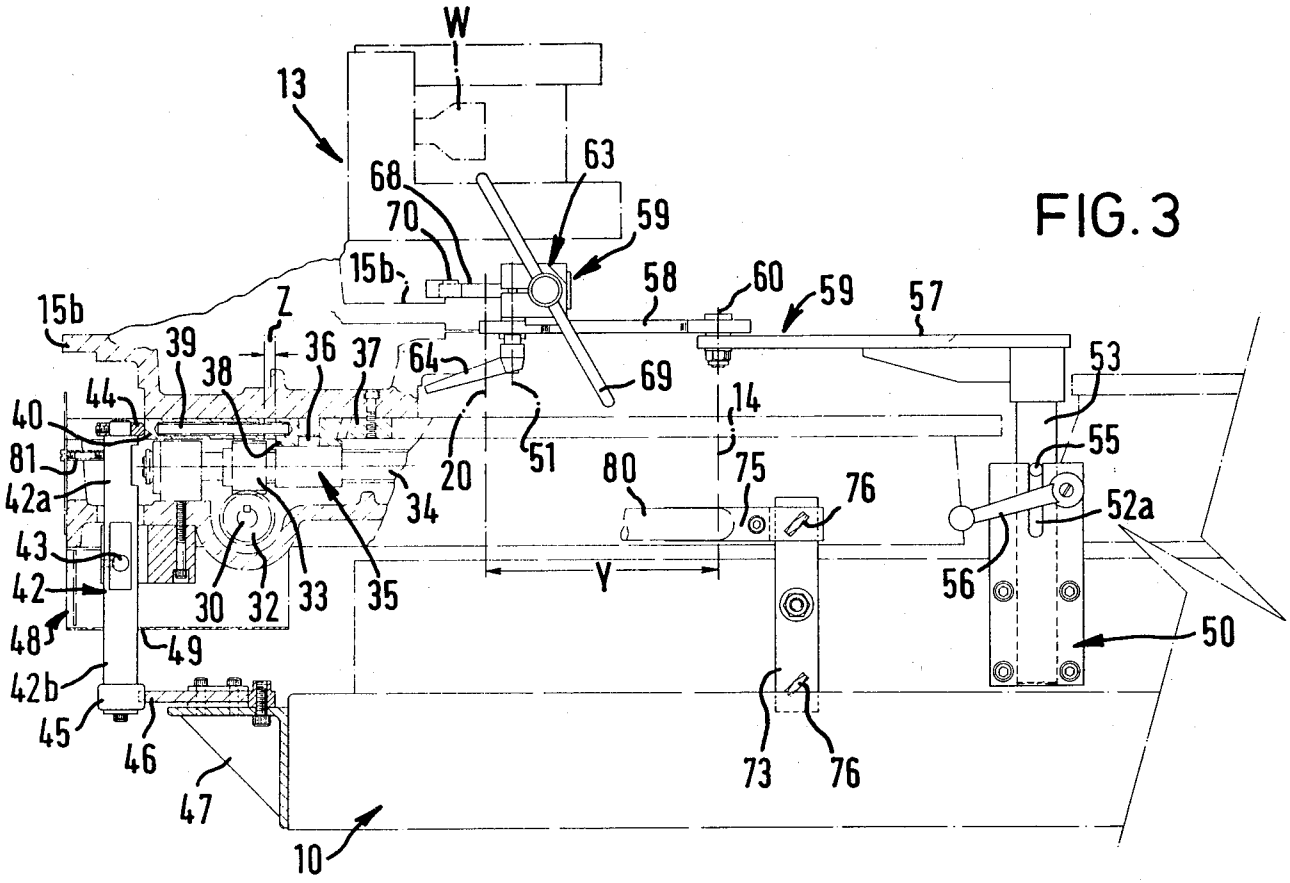
FIG. 3 is an elevation of part of the machine shown in FIGS. 1 and 2 shown partly in cross section adapted to form apparatus in accordance with the invention.
Figure 4:
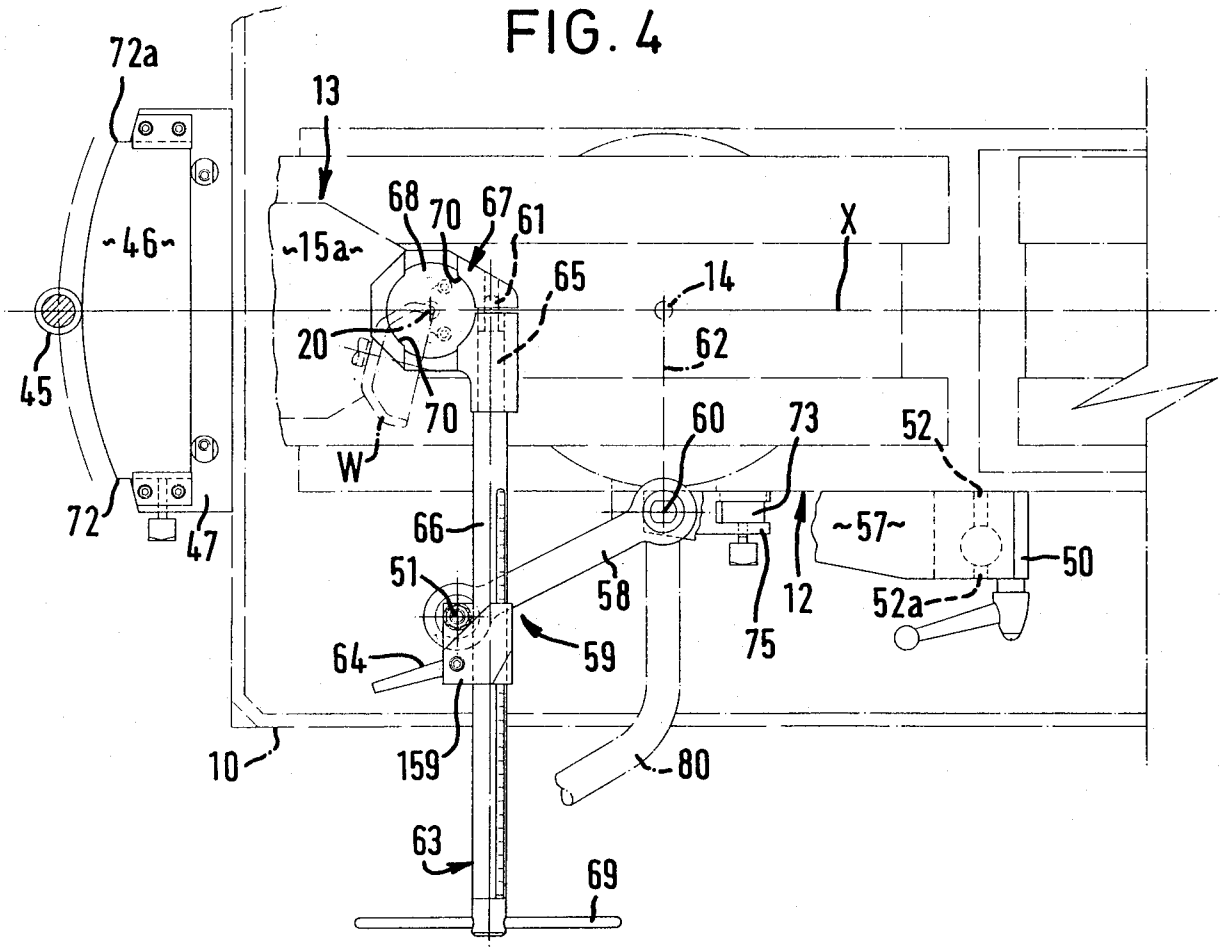
FIG. 4 is a plan view of the apparatus shown in FIG. 3.

Reference is now made to FIGS. 3 and 4 in which parts corresponding to parts in FIG. 1 carry the same reference numerals.

The handwheel 17 (not shown in FIGS. 3 and 4) is keyed to a shaft 30 which in turn is keyed to a gear 32. The gear meshes with a gear 33 on a lead screw 34 which transmits movement to the section **15*b* of tool carrier 13 via a screw threaded sleeve 35. The sleeve 35 has a projection 36 which normally engages an abutment 37 fixed to the lower portion 15*b* of the tool carrier and a block 38 loaded by three springs 39 arranged side by side and located in a spring holder 40 secured to the lower portion 15*b*. Only one of the springs 39 is shown. A lever 42 is movable about a pivot 43 on the mounting 12. The lever 42 has an upper portion 42*a* provided with a thrust block 44 and a lower portion 42*b* provided with a roller bearing 45. A cam 46, which may be profiled in a manner described in detail below, is secured to a bracket 47 on the bed 10. A casing 48 having an opening 49** for the lever may surround the lever arrangement.

The bed 10 also carries an upstanding tube 50 which is formed with diametral slots **52, 52*a*. The bore of the tube receives a pillar 53 which has a diametral peg 55 projecting from one side and which locates in one or other slot 52, 52*a*. A clamp 56 is provided which can be tightened to clamp the pillar in the tube. The upper end of the pillar 53 is rigidly secured to one end of an elongate plate 57 the other end of which plate is pivotally connected to one end of a first arm 58 of a linkage 59. The axis of pivoting of the first arm 58 on the plate 57 is indicated at 60 and lies on a line 62 passing through the axis 14. The other end of arm 58 is pivotally connected to a sleeve 159 (FIG. 4) which is mounted on a second arm 63. The axis of pivoting of arm 58 on sleeve 159 is indicated at 51. The sleeve carries a clamp 64 which can be tightened to lock the sleeve 159 in a desired position along the arm 63. The arm 63 comprises a rod 65 which passes through a calibrated tube 66 with working clearance and which is rotatably mounted in a clamp 67. The clamp 67 fits coaxially on a boss 68 on the upper portion 15*a* of the tool carrier 13. The rod 65 has a screw-threaded end 61 which screws into a section of the clamp so that rotation of the rod by means of a tommy bar 69 will pinch the clamp and secure it to the boss 68. Marginal flanges 70 of the clamp overlie the top of the boss to assist location of the clamp 67** on the boss.

Where it is necessary to generate a lens surface having a radius of curvature outside that which the basic Hyaline machine will accomodate, a said cam 46 having a profile determined as described below is selected and fastened to the bracket 47. The handwheel 17 is then rotated so as to move the tool carrier to the left until the lower portion **15*b* engages the thrust block 44 and urges the roller bearing 45 against the cam 46. The loading of the springs 39 is then increased by moving the sleeve 35 to the left so as to disengage the projection 36 from the abutment 37. In practice the axis 20 will then be spaced from axis 14 by a distance Y of around 175 mm on the Hyaline machine. A distance Z will also be defined between the block 38 and the adjacent end of spring holder 39 and the roller bearing 45 should be positioned at the lowest point of the cam i.e. point 72 or 72*a* in FIG. 4. By moving mounting 12 about axis 14 in the usual way the roller bearing 45 is forced to follow the cam 46 and moves the lever 42 about its pivot 43. Clockwise pivoting movement of the lever 42 causes the thrust block 44 to push the tool carrier along the slideway 11 against the bias of springs 39. Such movement reduces the distance Z but in practice the amount of sliding movement will not be sufficient to reduce Z to zero. During subsequent anticlockwise pivoting of the lever the springs 39 will urge the tool carrier to the left, the aforesaid increased loading ensuring that the thrust of the springs will overcome friction in the slideway 11**.

As the mounting 12 is pivoted about axis 14 the wheel W traverses the workpiece and the locus of the axis 20 is determined by the pivotal movement about axis 14 and the simultaneous movement of the tool carrier in a transverse direction as a result of the cam 46, lever 42 and springs 39. Therefore by selecting appropriate cams, the linear movement of the carriage can be controlled to enable a large range of plus lens surfaces including plano to be produced as well as a large range of minus curves as explained below with reference to FIGS. 5–7.

However, it will be appreciated that when generating a curve having a greater radius than the distance between axes 14 and 20 the grinding wheel is still, in fact, moving about axis 14 and not the notional axis about which the curve is being generated. For optimum accuracy it is highly desirable to control the orientation of the grinding wheel W about axis 20 so that its angular displacement corresponds to that which would take place if the mounting were pivoted about the aforesaid notional axis. The linkage 59 controls the orientation of the grinding wheel in the manner illustrated in FIGS. 5 to 7.

The bed 10 carries a centralising arm 73 which is pivotable about a bolt 74. The arm 73 is locatable in a birfuraced lug 75 secured to the mounting 12. When the arm 73 is so located the axis 20 intersects the centre line X (FIG. 4) of the workpiece (lens blank) 5, lines X and 62 being at right angles. The arm 73 can be locked in the lug 75 by a wing nut 76. Two such wing nuts are provided one each end of the arm 73.

Figure 5:
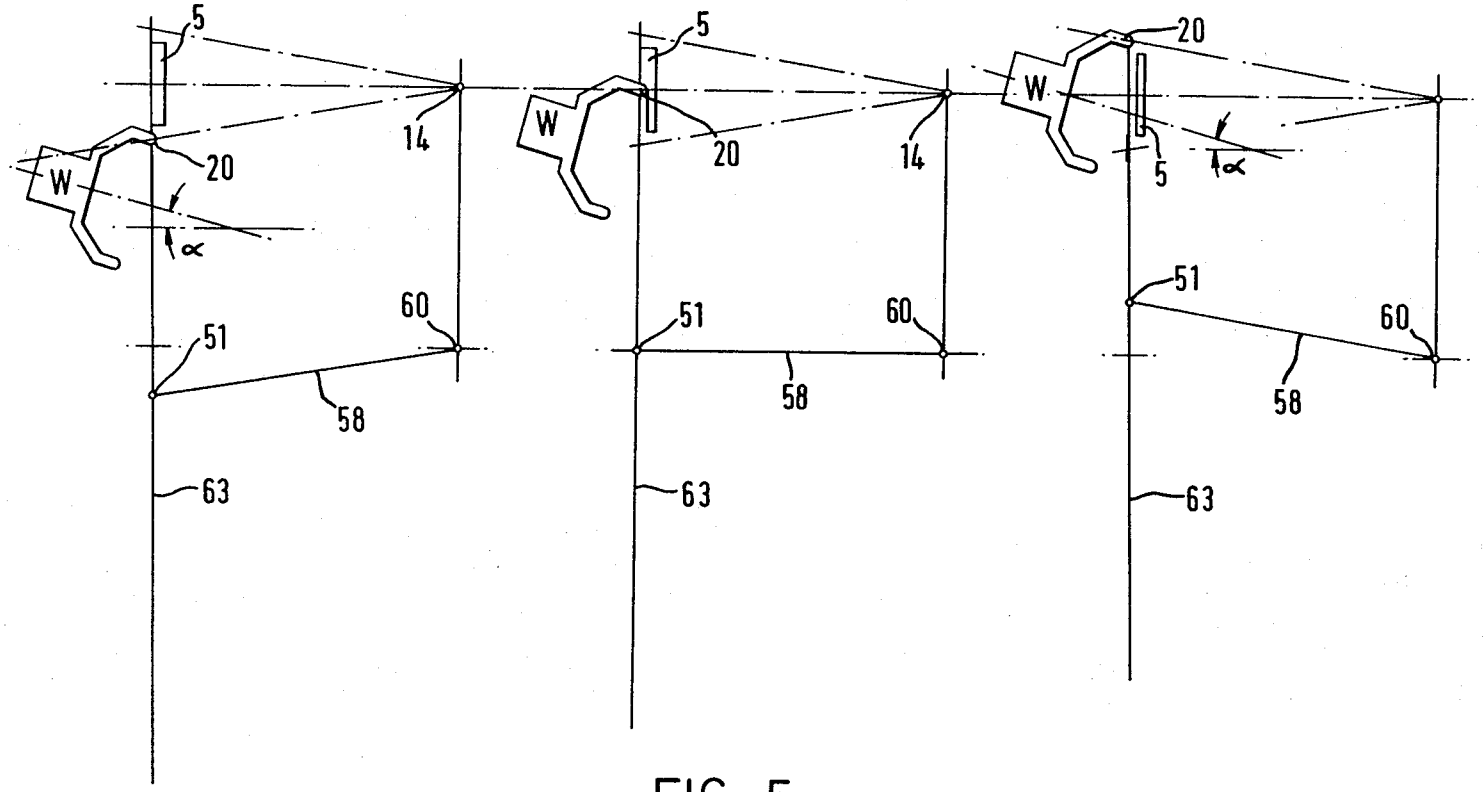
FIGS. 5–7 are diagrammatic views showing configurations of the aforesaid notional quadrilateral for plus plus and minus lens conditions respectively.

FIG. 5 shows the way in which a plano surface can be generated on the workpiece 5. First an appropriate cam 46 is selected and installed and then with the arm 73 located in lug 75 the position of the sleeve 159 is adjusted so as to align with a calibration on the tube 66. The setting will be such that the distance between axes 20, 51 is the same as the distance between axes 14, 60. On the Hyaline machine that distance will be 150 mm. The axes 14, 20, 51 and 60 then lie at the corners of a notional parallelogram. During adjustment of the sleeve 159 the clamp 67 is not clamped to the boss 68, the clamp being tightened after the setting of the sleeve has been completed. The centralising arm 73 can then be swung out of engagement with lug 75. The workpiece 5 is then traversed by the grinding wheel W and it will be appreciated that the angle $\alpha$ to which the grining wheel W has been set in the usual way remains constant over the entire transverse, the arm 63 undergoing a parallel movement and preventing movement of the section **15*b* relative thereto. With the grinding wheel set at angle $\alpha$, the surface generated is curved in a vertical plane. The traversing of the tool is effected by swinging the mounting 12 about axis 14 by means of a handle 80 part of which is shown in FIGS. 3 and 4**.

Figure 6:
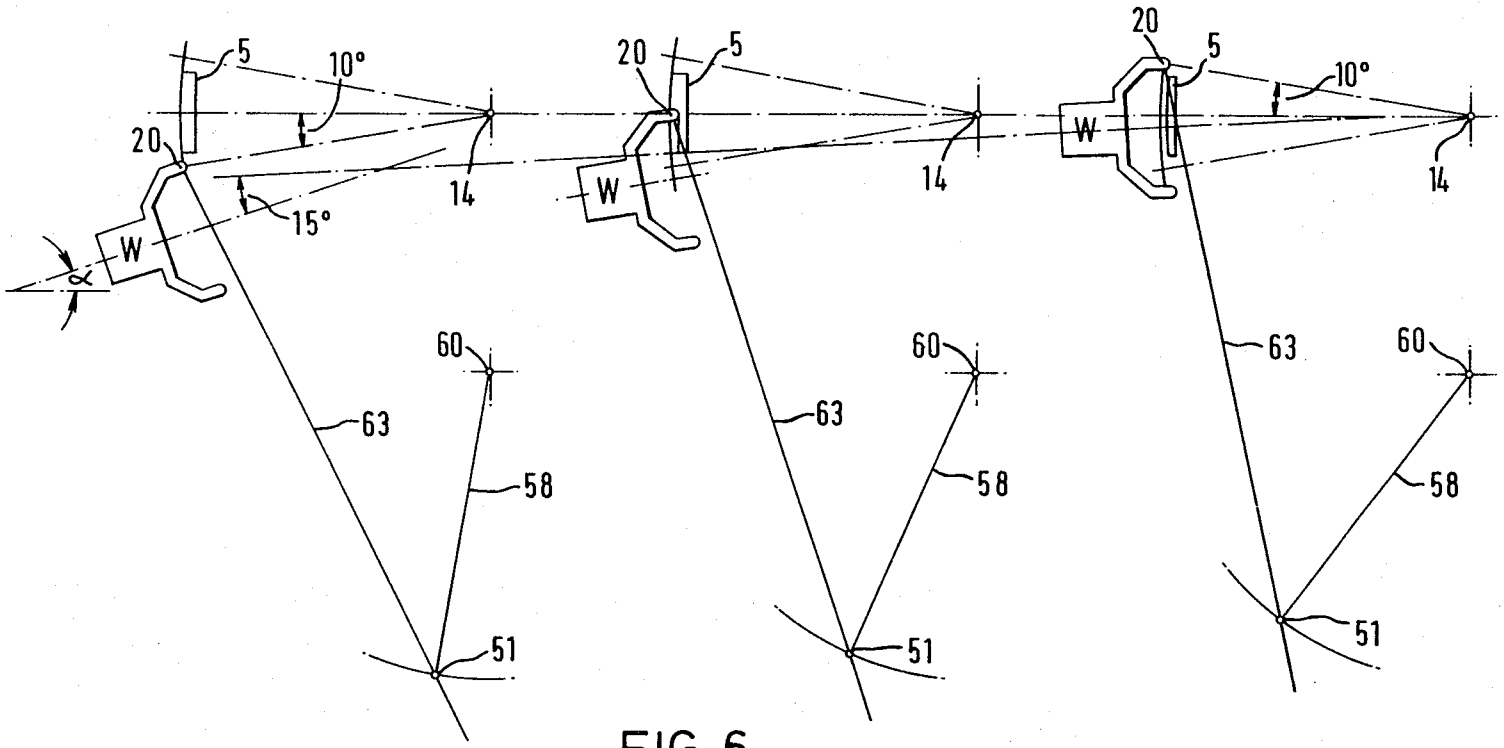

FIG. 6 shows the way in which a plus curve can be generated on the workpiece 5. The grinding wheel W is again set at a desired angle $\alpha$ about axis 20 and after selecting a cam 46 the sleeve 159 is positioned correctly on tube 66 with the clamp 67 loose on boss 68 and with the centralising arm 73 in the lug 75. The setting of the sleeve 159 will normally be given by tables supplied with the machine or by a calculator programmed appropriately. As will be appreciated, the axes 14, 20, 51 and 60 now lie at the corners of a notional trapezium and as the grinding wheel traverses the workpiece 5 the arm 63 swings clockwise. Although the mounting swings through an angle of, say, 20° (2×10°) the wheel W swings through a smaller angle, in this case 15°, which represents the angle through which it would swing if the mounting were being swung about an axis spaced from axis 20 by the radius of the curve being generated.

Figure 7:
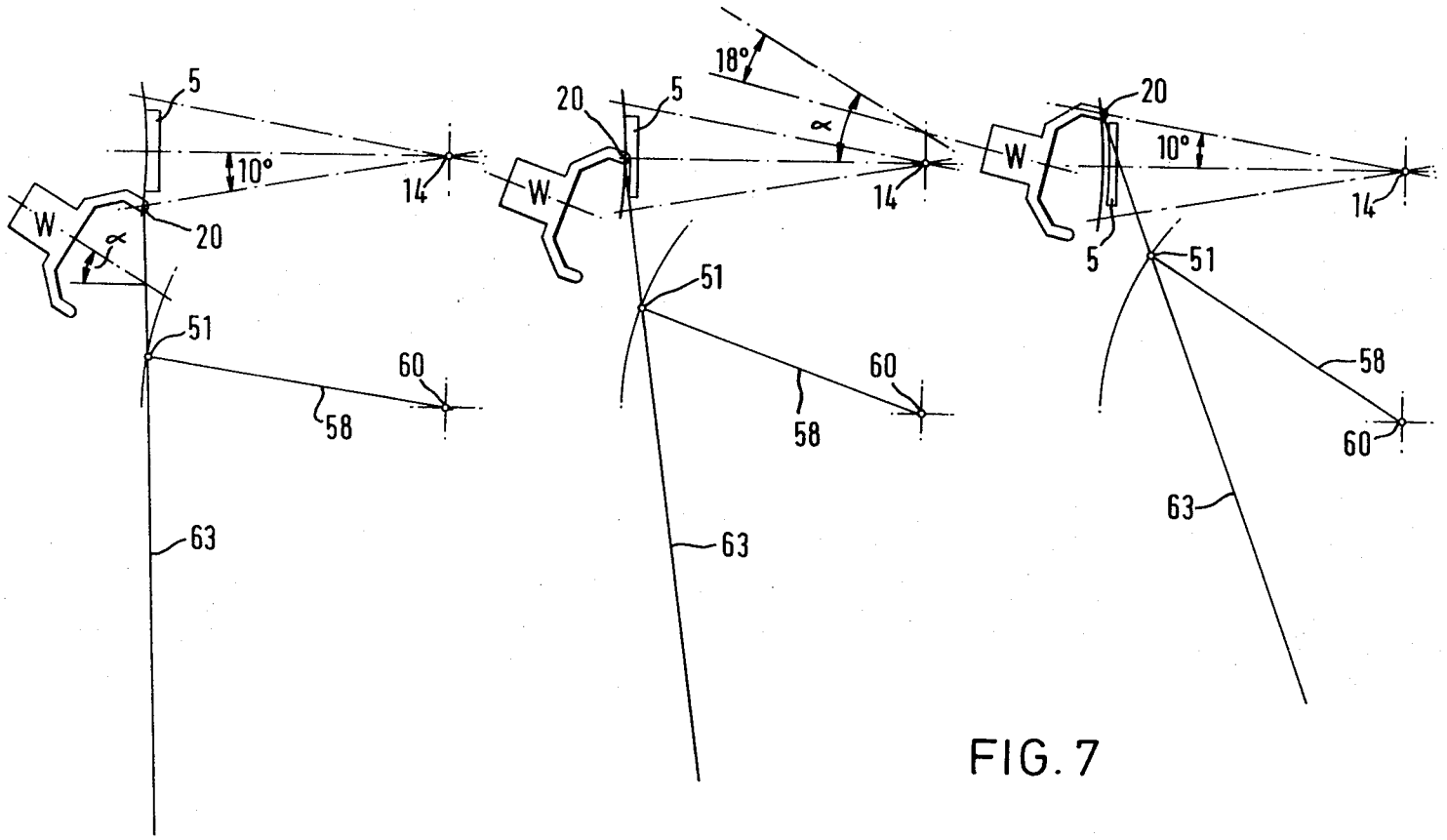

FIG. 7 shows the way in which the minus curve can be generated. The setting procedure is similar to that described with reference to FIGS. 5 and 6. As the grinding wheel traverses the workpiece 5 the arm 63 swings anticlockwise. In the example shown the mounting 12 swings about axis 14 through 20° while the wheel W swings through 18° in the opposite direction.

On the basic Hyaline machine the section **15*b* is locked to the section 15*a* by fluid operable clamps (not shown) once the angle $\alpha$ of grinding wheel has been set. Further fluid operable clamps (not shown) also lock the carrier 13 against movement in the slideway 11**. However, where the machine is adopted to operate in accordance with the invention, the aforesaid clamps are rendered inoperative.

Figure 8:
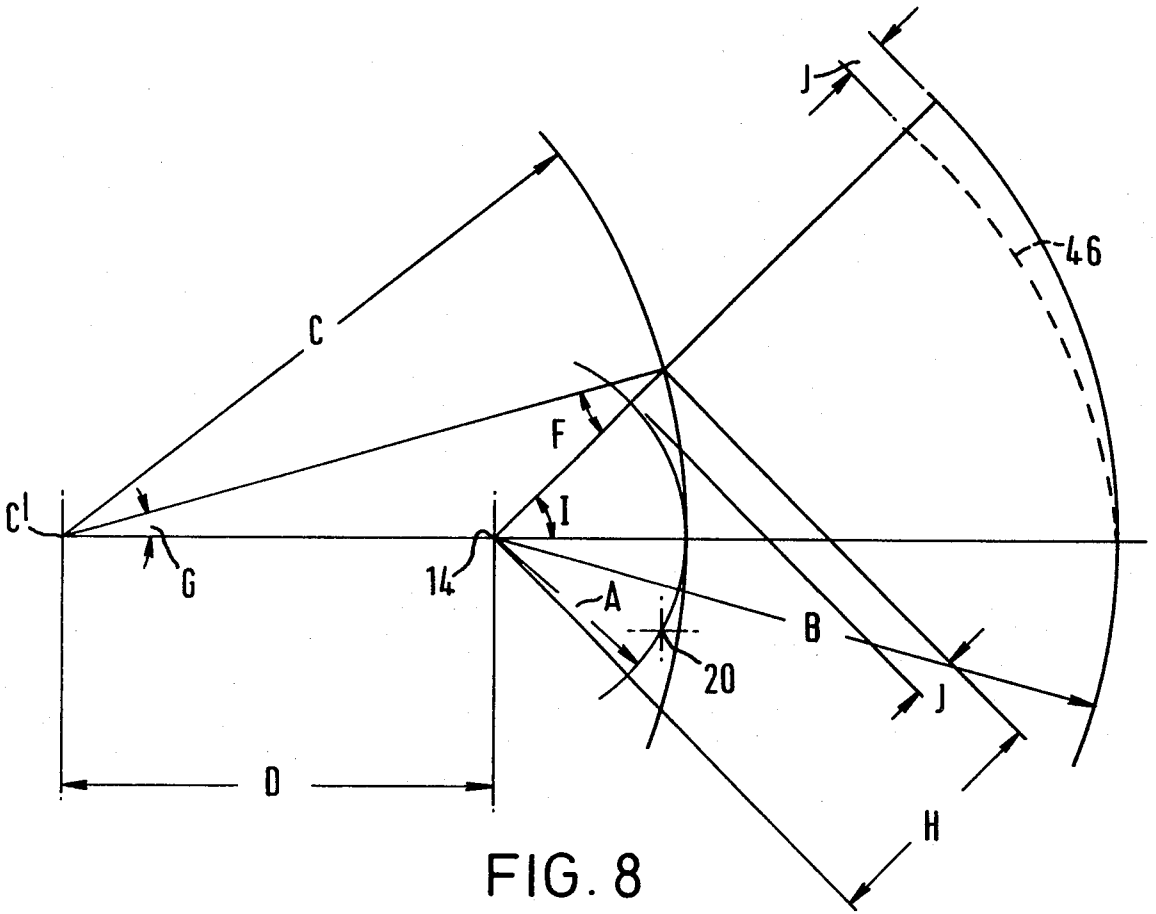
FIGS. 8 and 9 are geometrical diagrams used to determine the profile of the cam for plus and minus lens conditions respectively.
Figure 9:
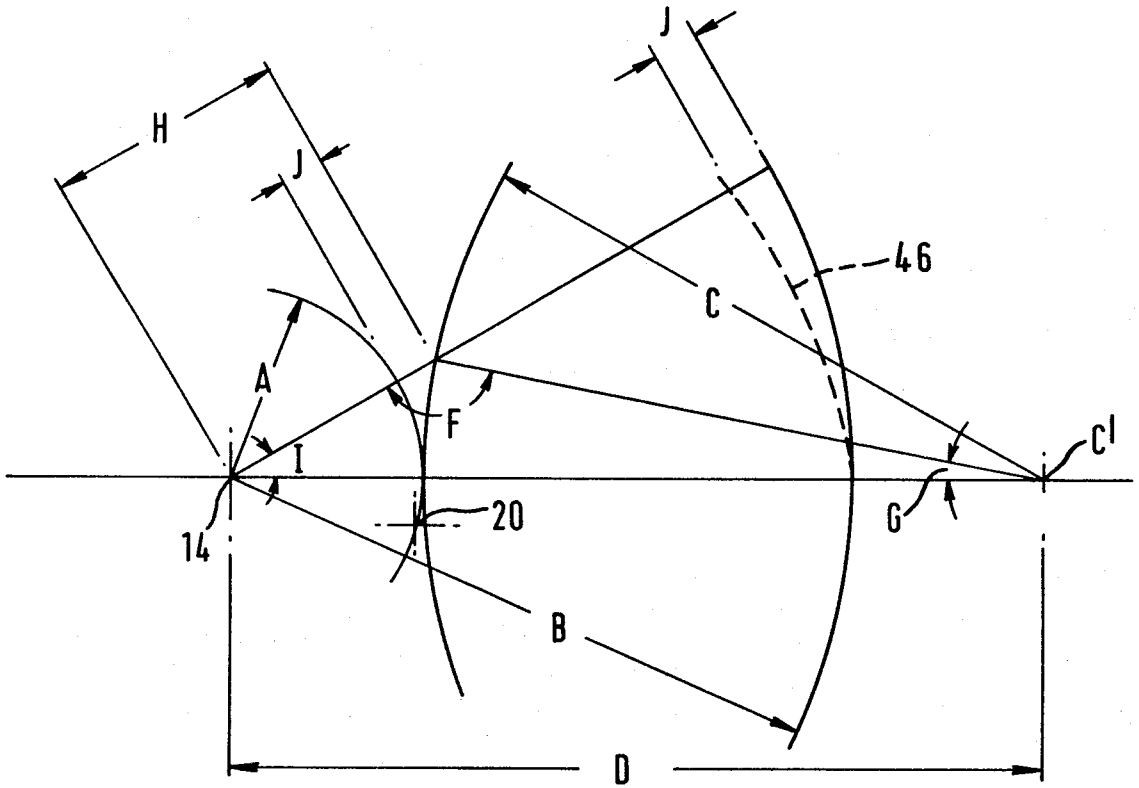

In FIGS. 8 and 9, FIG. 8 illustrates the geomestry involved in determining the shape of cams for plus curves and FIG. 9 for minus curves. In those Figures:

A = the distance between axes 14 and 20 when the machine is set as in FIGS. 3 and 4.

B = the swing radius of the roller 45 on the lever 42 when not loaded against the cam 46 by springs 39.

C = the radius of the desired curve to be ground about a notional axis $C^1$

I = the angle of any chosen point around the arc of movement of the grinding wheel or the arc of the cam follower Then:

$D=C-A$ in FIG. 8 ($D=C+A$ in FIG. 9)

$\sin F=(D \sin I)/C$ angle $G=I-F$ in FIG. 8 ($G=180-I-F$ in FIG. 9)

$H=(C \sin G)/(\sin I)$ $J=H-A$

J is the distance by which the grinding wheel must be displaced from its arc about axis 14 in order to grind the desired radius C. The amount J is also the amount which must be subtracted from the radius of swing of the bearing 45 to produce the correct amount of slide of carrier 13 on the mounting.

Therefore B−J is the polar co-ordinate of the cam profile an angle I and using a parametric form:

$$x=(B-J) \sin I$$

$$y=(B-J) \cos I$$

gives Cartesian co-ordinates of any point on the cam profile when xo,yo is the pivot point on axis 14.

In practice the cam profile is substantially a circular arc bearing in mind that angle I will usually be less than 10°.

It is proposed to supply cams 46 in ¼ dioptre steps from plus 2.75 dioptres through plano to minus 2.25 dioptres.

When it is desired to use the machine for producing lenses which do not require the use of the cam and lever arrangement, we prefer to hold the bearing 45 clear of the cam by means of a spring 81 (FIG. 3). The linkage 59 is also swung clear of the carrier 13 by lifting the pillar in tube 50 so that the peg 55 clears slot 52, rotating the pillar through 180° and then re-locating the peg 55 in the slot **52*a* which is deeper than slot 52. The plate 57 and arms 58, 63** are staggered vertically so that they can be pivoted to lie one above the other in a compact manner when not in use.

To change a cam, the mounting 12 can be swung about pivot 14 so that the lever is moved to one side well away from the bracket 47.

Instead of using a lever 42 to transmit movement, the cam could be arranged to engage the mounting 12 directly. Where the lever 42 is used it may provide a 1:1 or other suitable ratio.

Whilst specific reference has been made to the use of apparatus in accordance with the invention in the field of lens grinding it could have other applications.

Also it should be understood that the invention is not limited to the particular embodiments shown and described herein but that various changes and modifications may be made without departing from the spirit and scope of the invention.

What we claim as our invention and desire to secure by Letters Patent in the United States is:

1. Lens generating apparatus comprising a bed, a mounting pivotally mounted on the bed, a tool carrier supported on the mounting for pivotal movement therewith along a first path, and means for sliding the carrier along a second path generally transverse to the first path as a result of movement of the carrier along the first path, the tool carrier comprising a fixed first section on said mounting and a second section pivotally mounted on the first section to enable the orientation of the tool relative to a workpiece, and adjustment means for pivoting the second section relative to the first section as a result of said movement of the carrier along the first path.

2. Lens generating apparatus for effecting relative movement between a tool element and a workpiece element in a controlled manner, comprising a bed, a mounting pivotally mounted on the bed, a carrier supported on the mounting for pivotal movement therewith and carrying one of said elements, said bed carrying the other element, said carrier being movable along a first path, and means for moving the carrier along a second path generally transverse to the first path, said means comprising a fixed first part associated with said bed and a second part associated with said mounting and engaging said carrier for cooperation with the first part as the carrier is moved along said first path to effect relative movement between the tool and workpiece elements, the carrier being slidable, on interaction of said first and second parts, along the mounting to a desired position by a rotary screw which carries a screw-threaded sleeve, said sleeve being arranged to transmit drive to the carrier in one direction through an abutment fast with the carrier and in an opposite direction through resilient means, the arrangement being such that the second part moves the carrier along the second path against the bias of said resilient means in one direction and said resilient means effects return movement of said carrier.

3. Apparatus according to claim 2 in which said first part of the means for moving the carrier along the further path comprises a cam and said second part includes lever means on the mounting, said lever means including a first portion which engages the cam and a second portion which co-operates with the carrier.

4. Lens generating apparatus for effecting relative movement between a tool element and a workpiece element in a controlled manner comprising a bed, a mounting pivotally mounted on the bed, a carrier supported on the mounting for pivotal movement therewith and carrying one of said elements, said bed carrying the other element, said carrier being movable along a first path, and means for moving the carrier along a second path generally transverse to the first path as a result of movement of the carrier along the first path to effect relative movement between the tool and workpiece elements, said carrier comprising a fixed first section on the mounting and a movable section pivotally mounted on the first section to enable the orientation of said one of said elements to be varied relative to the other, adjustment means being provided which causes the movable section to pivot relative to the first section as a result of said movement of the carrier along the first path.

5. Apparatus according to claim 2, in which the carrier comprises a fixed first section on the mounting and a movable section pivotally mounted on the fixed first section to enable the orientation of said one of said elements to be varied relative to the other, adjustment means being mounted on the bed which pivots the movable section relative to the first section as a result of said movement of the carrier along the first path.

6. Apparatus according to claim 5 in which the adjustment means is a linkage comprising a fixed first arm connected to the bed by a first pivot and a second arm attachable to said movable section and connected to the first arm by a second pivot.

7. Apparatus according to claim 6 in which the distance between the second pivot of the linkage and the pivot of the movable section is adjustable by altering the position of the second pivot on the second arm, the pivot for the mounting, the pivot for said movable section and said first and second pivots of the linkage being located at the four corners of a notional quadrilateral so that the second arm follows a desired locus as the mounting is moved about its pivot to control movement of the said movable section about its pivot.

8. Apparatus according to claim 7 in which locking means is provided on the bed for locking the mounting means in a desired pivotal position relative to the bed prior to adjusting the position of said second pivot on the second arm of the linkage.

9. Apparatus according to claim 2, in which at least a part of the means for moving the carrier along said second path comprises a removable attachment for a machine.

10. Apparatus according to claim 4 in which the adjustment means comprises a removable attachment for a lens generating machine.

11. Apparatus according to claim 4, in which a part of the means for moving the carrier along said second path is a removable attachment.

* * * * *